United States Patent [19]

Bloeck

[11] Patent Number: 4,462,732

[45] Date of Patent: Jul. 31, 1984

[54] PROCESS FOR MANUFACTURING A CAN LID

[75] Inventor: Siegfried Bloeck, Kreuzlingen, Switzerland

[73] Assignee: Swiss Aluminium Ltd., Chippis, Switzerland

[21] Appl. No.: 466,951

[22] Filed: Feb. 16, 1983

[30] Foreign Application Priority Data

Mar. 5, 1982 [CH] Switzerland ..... 1380/82

[51] Int. Cl.[3] ..... B21D 51/00

[52] U.S. Cl. ..... 413/8; 156/69; 220/359

[58] Field of Search ..... 413/8, 12, 56, 59; 220/359, 260, 270; 156/69

[56] References Cited

U.S. PATENT DOCUMENTS

| | | | |
|---|---|---|---|
| 3,855,026 | 12/1974 | Fox et al. | 156/69 |
| 4,232,797 | 11/1980 | Walerburg | 220/359 |
| 4,332,846 | 6/1982 | Fischer et al. | 220/270 |
| 4,390,104 | 6/1983 | Cummings | 220/359 |

*Primary Examiner*—Leon Gilden

*Attorney, Agent, or Firm*—Bachman and LaPointe

[57] ABSTRACT

Can lids made of metal, lacquered on both sides and featuring a pouring outlet covered over with a closure strip having a sealing surface of polyamide, often exhibit inadequate bond strength between the closure strip and the lacquered can lid surface. The bond strength can be increased if the can lid, after the closure strip has been sealed onto it, is heated until the polyamide melts and then the can lid with closure strip is subsequently cooled.

2 Claims, 1 Drawing Figure

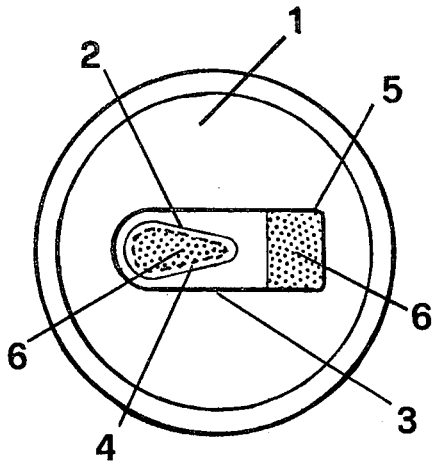
1
2
5
6
6
3
4

PROCESS FOR MANUFACTURING A CAN LID

BACKGROUND OF THE INVENTION

The present invention relates to a process for manufacturing a can lid which is lacquered on both sides and features at least one outlet which is covered by means of a sealed-on closure strip with polyamide sealing surface.

Lids for beverage cans are made of either aluminum, tin-plate or tin-free steel and are provided with one or more pouring outlets which are covered with a sealed-on closure strip. The metal can lids are normally coated with lacquer on both sides, for example, with a phenolic-epoxy resin coating. Known closure strips are made of a thin aluminum strip which is coated on the surface to be sealed with a thermoplastic material, for example, a polyamide.

It has been found that with metal can lids which are lacquer-coated on both sides and feature sealed-on closure strips of an aluminum-polyamide laminate, that the adhesive strength of the polyamide sealing layer on the lacquered lid surface is inadequate when used on cans having high internal pressures, for example, cans containing carbonated drinks stored for extended periods at temperatures above 30° C.

In view of the foregoing it is the principal object of the present invention to develop a process as set forth above wherein the adhesive strength of the closure strip on the lid can be increased.

SUMMARY OF THE INVENTION

The foregoing object is achieved by way of the present invention wherein the can lid, after the closure strip has been sealed onto it is heated until the polyamide coating melts and thereafter the can lid with closure strip is cooled.

By way of the process of the present invention, it is possible to produce metal lids, which are lacquer-coated on both sides and have a strongly adherent closure strip. It turns out that, in particular with the thickness of material required for lids for carbonated drinks cans, it is not possible to supply sufficient heat to the sealing zone without overheating and thereby damaging the lacquer on the inner side of the lid.

By heating the lid after sealing-on the closure strip the strength of adhesion of the closure strip to the lid is increased considerably. In addition, mechanical stresses produced in the region of the opening when the opening is stamped out are markedly lowered as a result of the heating.

In order to produce the necessary melting of the polyamide, for example polyamide-12, it is sufficient to heat the lid to a temperature of between 175° to 300° C. The duration of the heating depends on the temperature employed, that is, at higher temperatures a shorter heating time is required.

For the temperature range set forth above, times of from about 0.5 seconds to 2 minutes are required.

BRIEF DESCRIPTION OF THE DRAWING

Further advantages, features and details of the present invention will be made clear from the following description of a preferred embodiment and with reference to the drawing which shows a can lid with sealed-on closure strip.

DETAILED DESCRIPTION

A can lid 1, made of an aluminum alloy and coated on both sides with a phenolic epoxy resin, is provided with an outlet opening 2 which is covered over along a seam 4, for example 2–3 mm wide, by a closure strip 3 made of an aluminum thin strip coated with polyamide 12.

The closure strip features a free-standing pull-off tab 5. The area of the closure strip 3 spanning the outlet opening 2 and the pull-off tab are embossed.

The following example illustrates the advantages obtained by way of the process of the present invention.

Can lids with pouring outlets were manufactured out of a 0.33 mm thick sheet of an aluminum alloy coated on both sides with a phenolic epoxy resin lacquer. A closure strip made of an aluminum-polyamide-12 laminate was sealed over the pouring outlets under the following conditions:

Temperature of upper sealing tool: 250° C.
Temperature of lower sealing tool: 130° C.
Sealing time: 0.6 sec
Specific sealing pressure: 1000 N/cm$^2$ Some of these lids with their sealed-on closure strips were subsequently heated for 20 seconds at 270° C. in a furnace with forced circulation of air.

Forty cans having a nominal diameter of 65 cm were filled with 0.3 liters of a carbonated drink. Twenty of the cans were fitted with lids which had been provided with closure strips sealed thereon under the above mentioned conditions with the subsequent heat treatment and twenty were fitted with lids which were not subsequently heat treated. The cans were then stored at a temperature of 40° C. The pressure inside the cans was 4.4 bar.

The closure strips on the twenty can lids which had not been subsequently heat-treated came free after 5 days of storage. The twenty can lids which had been subsequently heat-treated showed no signs of the closure strips even starting to free themselves after a storage time of 3 months.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for manufacturing a metal can lid which is lacquer-coated on both sides and provided with a sealed-on closure strip having a sealing surface of polyamide covering the pouring outlet of the lid comprising heating the can lid after the closure strip has been sealed thereon until the polyamide melts and thereafter cooling the can lid.

2. A process according to claim 1 wherein the can lid is heated for from about 0.5 seconds to 2 minutes in a temperature range of from about 175° to 300° C.

* * * * *